US007497170B2

(12) United States Patent
Fortuna et al.

(10) Patent No.: US 7,497,170 B2
(45) **Date of Patent: *Mar. 3, 2009**

(54) OPERATING SHAFT ASSEMBLY FOR RAILCARS

(75) Inventors: Rudolph S. Fortuna, Oak Creek, WI (US); Brian A. Senn, South Milwaukee, WI (US)

(73) Assignees: Powerbrace Corporation, Kenosha, WI (US); Miner Enterprises, Inc., Geneva, IL (US)

( * ) Notice: Subject to any disclaimer, the term of this patent is extended or adjusted under 35 U.S.C. 154(b) by 480 days.

This patent is subject to a terminal disclaimer.

(21) Appl. No.: 11/255,667

(22) Filed: Oct. 21, 2005

(65) Prior Publication Data

US 2007/0089640 A1 Apr. 26, 2007

(51) Int. Cl.
*B61D 3/00* (2006.01)

(52) U.S. Cl. ..... 105/286; 105/282.2

(58) Field of Classification Search ..... 105/282.1–289, 105/294, 305

See application file for complete search history.

(56) References Cited

U.S. PATENT DOCUMENTS 4,342,267 A * 8/1982 Blout ..... 105/282.2
5,353,713 A 10/1994 Dohr et al.
5,671,684 A * 9/1997 Lucas ..... 105/305
5,829,359 A * 11/1998 Dohr et al. ..... 105/310
2007/0089639 A1* 4/2007 Fortuna ..... 105/286
2007/0089640 A1* 4/2007 Fortuna et al. ..... 105/286

* cited by examiner

*Primary Examiner*—S. Joseph Morano
*Assistant Examiner*—Jason C Smith
(74) *Attorney, Agent, or Firm*—Law Office of John W. Harebst

(57) ABSTRACT

A railcar operating shaft assembly including an operating shaft having first and second ends with a capstan provided at each end of the operating shaft. Each capstan defines an axis about which the capstan rotates and has first and second axially aligned end portions. One end portion of each capstan is releasably connectable to one end of the operating shaft. The second end portion of each capstan defines a socket opening to a terminal end of the second end portion of the capstan. The socket defined at the free end of the second end portion of the capstan is axially aligned with the longitudinal axis of the capstan. An insert is configured for non-rotatable accommodation within the socket defined at the second end portion of each capstan. The insert defines a bore axially aligned with the longitudinal axis of the capstan and has a closed and non-circular marginal edge extending axially inward from the terminal end at the second end portion of the capstan. A locking apparatus positively secures the insert within the socket defined by the capstan so as to inhibit inadvertent separation of the insert from the capstan.

22 Claims, 6 Drawing Sheets

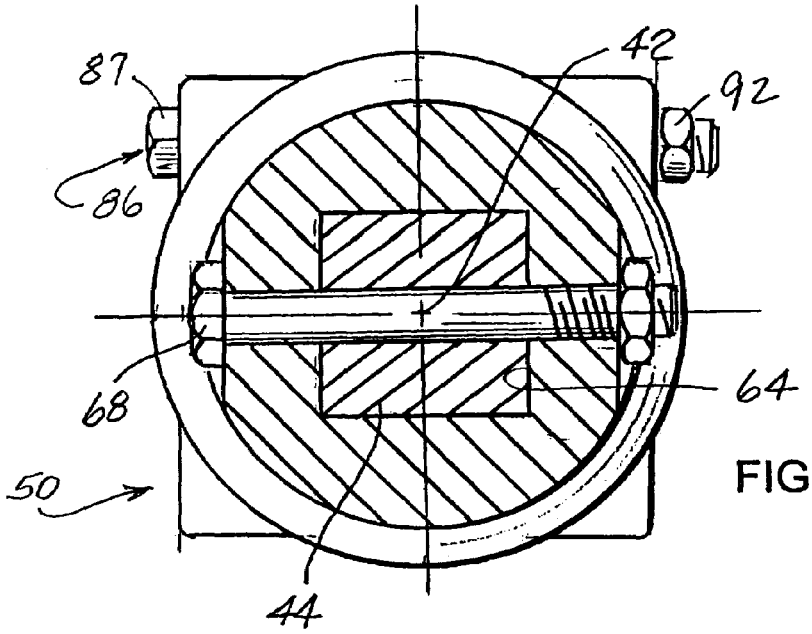
FIG. 5
FIG. 6
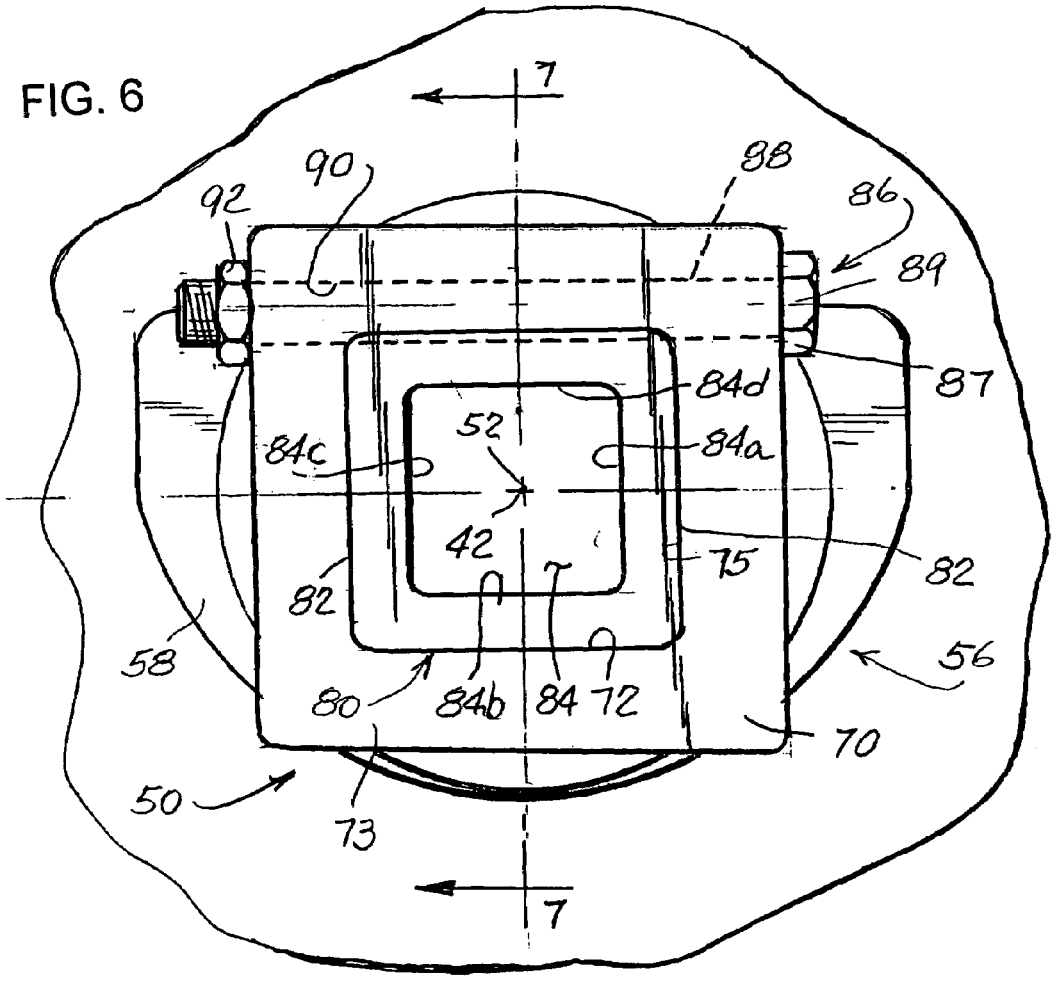

OPERATING SHAFT ASSEMBLY FOR RAILCARS

FIELD OF THE INVENTION

The present invention generally relates to railcars and, more specifically, to an operating shaft assembly for operating a gate assembly on a railcar.

BACKGROUND OF THE INVENTION

Railroad hopper cars are used to economically transport commodities between distantly spaced geographic locations. Granular commodities, i.e., corn, grain and etc., can be rapidly discharged from the hopper car through gate assemblies mounted in material receiving relation relative to standard discharge openings on a bottom of the hopper car. Each gate assembly typically includes a rigid frame connected to the bottom of the hopper car and defining a discharge opening. A gate is slidably movable on the gate assembly frame for controlling the discharge of commodity through the discharge opening. An operating shaft assembly is also mounted on the frame in operable combination with and for moving the gate between closed and open positions.

A typical operating shaft assembly includes an elongated shaft supported at opposite ends for rotation about a fixed axis by operating handles which are sometimes referred to as capstans. Each capstan or operating handle is operably connected in nonrotatable relation relative to each end of the elongated shaft and is journalled for rotation by an extension on the gate assembly frame. Each capstan has a generally hollow end exposed to the side of the railcar. That is, a free end of a conventional capstan is configured to allow an elongated opening bar to be passed through aligned slots on opposed sides of an elongated axis, about which the capstan turns, and further includes a generally square socket or opening for accommodating a drive spindle of a mechanical opener. Their size and shape is not conducive to casting a capstan from steel. Accordingly, a typical capstan is made from cast iron. As known, cast iron also has wear and lubricity advantages over a similar steel part.

Once a hopper car reaches an unloading site, the gate is slid open and gravity causes the commodity within the hopper car to readily flow therefrom. As will be appreciated by those skilled in the art, the commodity within the car exerts a relatively large columnar load on an upper surface of a closed gate. Such downward load on the gate has caused and continues to cause a significant problem in manual opening of the gate at the unloading site. Of course, at the unloading site, time is of the essence and any complications involving opening of the discharge gate to unload the commodity presents serious concerns.

Since the time involved with unloading of the hopper car has become of paramount concern, mechanized gate openers are becoming more common. These mechanical openers, however, are much more abusive to the operating handles or capstans than when an elongated bar is used to manually open the gate. With a mechanical opener, a drive spindle is inserted into and engages the marginal edges of the generally square socket on the capstan to transmit opening torque to the operating shaft assembly. The drive spindle on such mechanical drivers usually includes a guide at the free end of the spindle for guiding the drive spindle into the square opening at the free end of the capstan.

Unless the mechanical opener is operated with care, however, the drive spindle is frequently engaged and turning when it is initially inserted into the square opening in the capstan.

The high speed turning or rotating movement of the drive spindle relative to the stationary capstan frequently acts to wear against the marginal edges of the square opening in the capstan. Moreover, and because of the relatively large columnar load placed on the gate by the commodity within the car, the drive spindle of the mechanical opener frequently slips within the square socket defined by the capstan, especially at the onset of the gate opening movements. Additionally, the railcar gate assembly is frequently provided with solid stops for limiting fore-and-aft movements of the gate. After the gate reaches either stop, continuing rotation of the drive spindle of the mechanical opener within the now stopped capstan often results in further wear to the square shaped opening in the capstan.

As known, relative movement between the drive spindle of the mechanical opener and the square socket opening defined by the capstan, regardless of the reason, tends to cause the marginal edges of the square socket or opening defined by the capstan to rapidly wear and eventually become circular rather than square in shape. Of course, the more wear imparted to the capstan, greater is the loss in the ability to transmit torque to the operating shaft assembly to thus affect timely opening of the gate.

Known solutions to a worn opening on the capstan involves either welding a flat plate having a square hole or opening therein to the free end of the capstan or replacement of the entire capstan. Each proposal has serious drawbacks. First, welding a plate with a square hole therein to a cast iron capstan does not usually produce a strong weld. Thus, the plate must be of a low alloy to allow any sort of welding to the cast iron capstan to be successful. Because the plate is of a low alloy, however, the marginal edges of the square hole in the plate become quickly worn by the drive spindle and the above-mentioned torque requirements. Second, welding a plate to the capstan requires the railcar having the worn capstans to be taken out of rail service. Third, welding a plate to the worn capstan requires an experienced and skilled welder coupled with the time and expense of providing and moving welding equipment to the remote location wherein the railcar is being repaired. Moreover, if the square hole in the plate is not exactly aligned with the rotational axis of the capstan, the plate is likely to break-off from the capstan or will become quickly worn as a result of such axial misalignment. If the plate having a misaligned drive socket or opening thereon does not break-off from the capstan, rotation of the plate with the axially misaligned drive socket or opening will impart adversely affecting stresses to the railcar gate assembly. Suffice it to say, welding a plate to the worn capstan is time consuming and is not logistically or financially prudent.

Replacing capstan having a worn drive socket or opening is likewise time consuming since the railcar again needs to removed and taken out from rail service to affect such replacement. After removing the railcar with the worn capstan from service, considerable time is typically spent disconnecting the worn capstan from the operating shaft followed by the reassembly of the new capstan to the operating shaft. As will be readily appreciated, replacing a capstan having a worn drive socket or opening is expensive as comparted to welding a plate to the free end of the capstan. Moreover, removing the capstans from the operating shaft frequently results in inadvertent separation of the operable drive connection between the operating shaft and gate. As such, when the capstans are removed from the operating shaft assembly, the timing relationship between the operating shaft assembly and gate movement can also be adversely affected.

Thus, there is a need and continuing desire for a quick and economical solution to the heretofore known problems associated with worn operating handles or capstans on a railcar operating shaft assembly used to operate a railcar gate assembly.

SUMMARY OF THE INVENTION

According to one aspect, there is provided a railcar operating shaft assembly including an operating shaft having first and second ends with a capstan provided at each end of the operating shaft for rotatably mounting the operating shaft assembly on a frame assembly of a railcar gate assembly. Each capstan defines a longitudinal axis about which the capstan rotates and has first and second axially aligned end portions. The first end portion of each capstan is operably connectable to one end of the operating shaft. The second end portion of each capstan defines a socket opening to a free or terminal end of the second end portion of the capstan. The socket defined at the free end of the second end portion of the capstan is axially aligned with the longitudinal axis of the capstan. A replaceable insert is configured for non-rotatable accommodation within the socket defined at the second end portion of each capstan. The replaceable insert is configured with a bore axially aligned with the longitudinal axis of the capstan and has a closed, non-circular marginal edge extending axially inward from the terminal end at the second end portion of the capstan. A locking apparatus positively secures the insert within the socket defined by the capstan so as to inhibit inadvertent separation of the insert from the capstan.

In one form, a fastener couples the capstan and operating shaft in operable combination relative to each other. Preferably, the capstan is provided with cam structure for imparting timely movements to a lock assembly arranged in operable combination with the gate assembly. Moreover, each capstan preferably includes a head portion arranged toward the second end portion thereof allowing for manual operation of the operating shaft assembly. The head portion on the capstan preferably defines two pairs of openings passing therethrough. Each pair of openings has a closed marginal edge and is disposed in generally normal relation relative to the other pair of openings. Each pair of openings is preferably disposed along an axis extending generally normal to the longitudinal axis of the capstan. In one form, a pair of substantially identical pinion gears are mounted on the operating shaft for operably coupling the operating shaft assembly to a gate provided with the railcar gate assembly.

In one embodiment, the replaceable insert arranged in the opening at the second end portion of each capstan includes first and second members arranged in layered relation relative to each other. In this form, the first and second members comprising the insert are fabricated from different materials. In an alternative embodiment, the insert to be arranged in the opening at the second end portion of each capstan includes multiple layers of material, including an elastomeric layer, for attenuating impacts imparted to the insert by a drive spindle of a mechanized driver used to open and close the gate of the railcar gate assembly.

According to another aspect, there is provided a railcar operating shaft assembly including an operating shaft having first and second ends with an axially elongated one-piece capstan operably connected to each end of the operating shaft for rotatably mounting the operating shaft assembly on a frame assembly of a railcar gate assembly. Each capstan defines an elongated axis about which the capstan rotates and has first and second axially aligned end portions. One end portion of each capstan defines a bore for non-rotatably accommodating one end of the elongated operating shaft. The second end portion of each capstan defines a cavity opening to a terminal end of the second end portion of the capstan. The cavity opening to the terminal end of the second end portion of the capstan is axially aligned with the elongated axis of the capstan. A replaceable insert is configured for non-rotatable accommodation within the cavity defined at the second end portion of each capstan. The replaceable insert is configured with a bore axially aligned with the elongated axis of the capstan and has a closed and non-circular marginal edge configuration extending axially inward from the terminal end at the second end portion of the capstan. An apparatus is provided for positively locking the insert within the cavity defined by the capstan so as to inhibit inadvertent separation of the insert from the capstan.

In one form, each said capstan includes a head portion arranged toward the second end portion thereof allowing for manual turning of the operating shaft assembly. In one embodiment, the head portion of the capstan defines two pairs of openings passing therethrough. Each pair of openings has a closed marginal edge and is preferably disposed in generally normal relation relative to the other pair of openings. Moreover, each pair of openings is disposed along an axis extending generally normal to the elongated axis of the capstan. Preferably, the operating shaft assembly further includes a pair of substantially identical pinion gears mounted on the operating shaft for operably connecting the operating shaft assembly to a slidable gate on the gate assembly.

In one form, the replaceable insert and the capstan are made from different materials. In another form, the insert fit into the cavity at the second end portion of the capstan includes first and second members arranged in layered relation relative to each other. Where the replaceable insert has a layered construction, the first and second members are preferably made from different materials. Alternatively, the replaceable insert fit into the cavity at the capstan's second end portion includes multiple layers of material, including an elastomeric layer, for attenuating impacts imparted to the insert by a drive spindle of a mechanized driver used to open and close the gate of the railcar gate assembly.

According to another aspect, there is provided a capstan for an operating shaft assembly of a railcar gate assembly. The capstan defines an elongated axis about which the capstan rotates along with first and second axially aligned and spaced end portions. One end portion of the capstan defines a bore with a closed non-circular marginal edge. The second end portion of the capstan defines a cavity axially aligned with the elongated axis of and opens to a terminal end of the second end portion of the capstan. The capstan further includes a replaceable insert arranged in axially aligned relation relative to the elongated axis of the capstan, with at least a portion of the insert being axially and non-rotatably accommodated within the cavity defined at the second end portion of the capstan such that rotational movement imparted to the insert is transferred to the capstan. The replaceable insert has at least two surfaces arranged in flanking relationship with and extending generally parallel to the elongated axis of the capstan. The capstan further includes an apparatus for positively locking the insert within the cavity defined by said capstan so as to inhibit inadvertent separation between the insert and the capstan.

In a preferred form, the capstan further includes a head portion arranged toward the second end portion of the capstan. The head portion of the capstan defines two pairs of openings passing therethrough. Each pair of openings has a closed marginal edge and is disposed in generally normal relation relative to the other pair of openings. Moreover, each pair of openings is disposed along an axis extending generally normal to the elongated axis of the capstan.

Preferably, each replaceable insert for the capstan defines a bore adapted to be axially aligned with the elongated axis of the capstan and has a closed marginal edge configuration extending axially inward from the terminal end at the second end portion of the capstan. In one form, the insert and capstan are fabricated from different materials. In another embodiment, the replaceable insert includes first and second members arranged in layered relation relative to each other; with layer members being fabricated from different materials. In still another form, the replaceable insert for the capstan includes multiple layers, including a layer of elastomeric material, for attenuating impacts imparted to the insert by a mechanized driver.

One feature of this invention relates to providing an operating shaft assembly for a railcar gate assembly, wherein the operating shaft assembly includes a capstan at each end of an operating shaft, and wherein each capstan includes an insert allowing for quick and ready repair/replacement of only that component which becomes worn or damaged from use of a mechanized driver.

Another feature of this invention relates to providing an operating shaft assembly for a railcar gate assembly and which includes an operating shaft having a capstan at each end thereof, and wherein each capstan includes a replaceable part which can be fabricated from materials different from the capstan, is simple to manufacture, and can be reasonably priced.

Still another feature of this invention relates to the provision of an operating shaft assembly for a railcar gate assembly and which includes an elongated operating shaft having a capstan at each end thereof, and wherein each capstan includes a replaceable part at a distal end thereof so as to readily allow a worn part on the capstan to be readily replaced without requiring the entire car to be removed from service.

Still another feature of this invention relates to providing a capstan for an operating shaft of railcar gate assembly wherein the capstan includes an insert allowing for quick and ready repair/replacement of only that part of the capstan which becomes worn or damaged from use of a mechanized driver.

These and other features, objects aims and advantages of the present invention will become more readily apparent from the following detailed description, the drawings, and the appended claim program.

DESCRIPTION OF THE DRAWINGS

FIG. 5 is an enlarged sectional view taken along line 5-5 of FIG. 1;

FIG. 6 is an enlarged side view of operating shaft assembly capstan embodying features of the present invention;

DETAILED DESCRIPTION OF THE INVENTION

Figure 1:
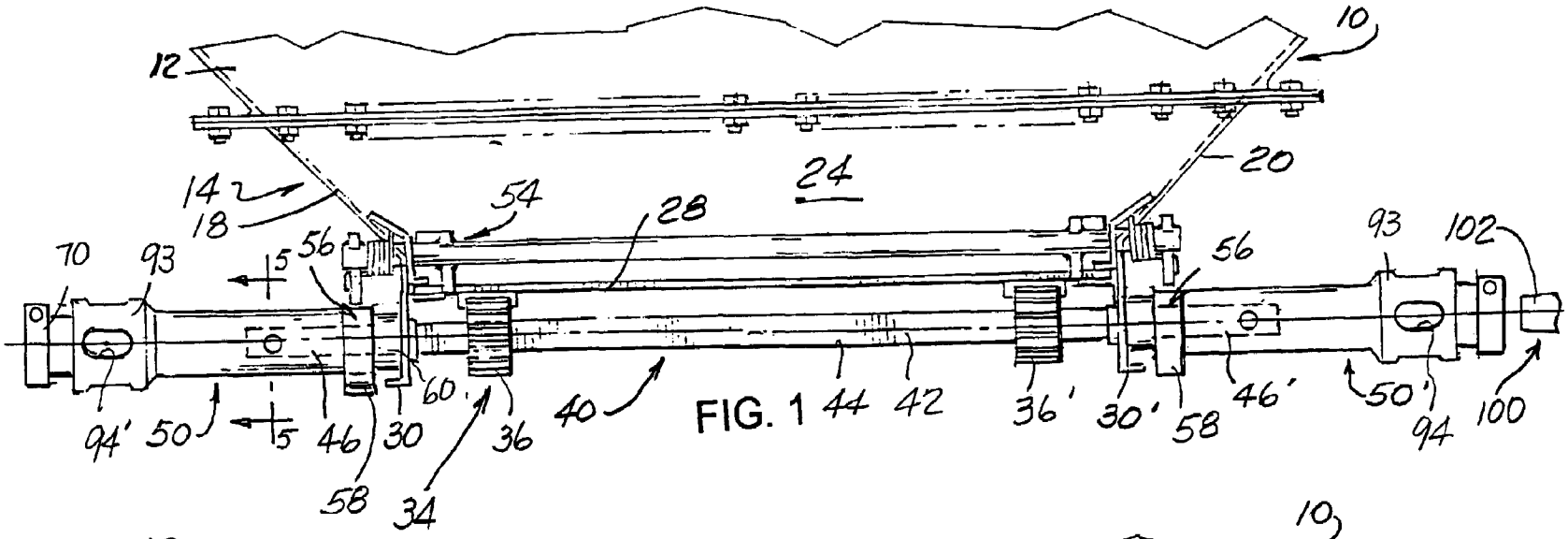
FIG. 1 is a rear elevational view of a railroad hopper car discharge gate assembly with an operating shaft assembly embodying features of the present invention.

While the present invention is susceptible of embodiment in multiple forms, there is shown in the drawings and will hereinafter be described preferred embodiments of the invention, with the understanding the present disclosure sets forth exemplifications of the invention which are not intended to limit the invention to the specific embodiments illustrated and described.

Referring now to the drawings, wherein like reference numerals indicate like parts throughout the several views, there is shown in FIG. 1 a railroad hopper car, generally indicated by reference numeral 10. As is conventional, the railcar 10 is schematically illustrated as including an outlet 12 which opens to the bottom of the car 10. Typically, the hopper car 10 has more than one outlet provided thereon. Since the outlets are all substantially the same, however, only one outlet is shown for purposes of this description.

To control the discharge of commodity from the outlet, a discharge gate assembly 14 is arranged in operable combination with each railcar outlet 12. The railcar gate assembly 14 includes a rigid frame assembly 16 formed of respective opposed sides 18, 20 (FIG. 1) and opposed ends 22, 24 (FIG. 2) which combine to define a discharge opening 26 (FIG. 3) therebetween, In the gate assembly illustrated, and toward their lower ends, the sides 18, 20 and ends 22, 24 each define common support structure upon which a door or gate 28 is mounted for sliding movement between open and closed positions.

Projecting away from end 24 and extending lengthwise of the railcar 10, frame assembly 16 further includes generally parallel frame extensions 30, 30'. As shown in FIG. 1, the frame extensions 30, 30' are laterally separated by a predetermined distance and serve to support the gate 28 when it is moved to an open position.

Figure 2:
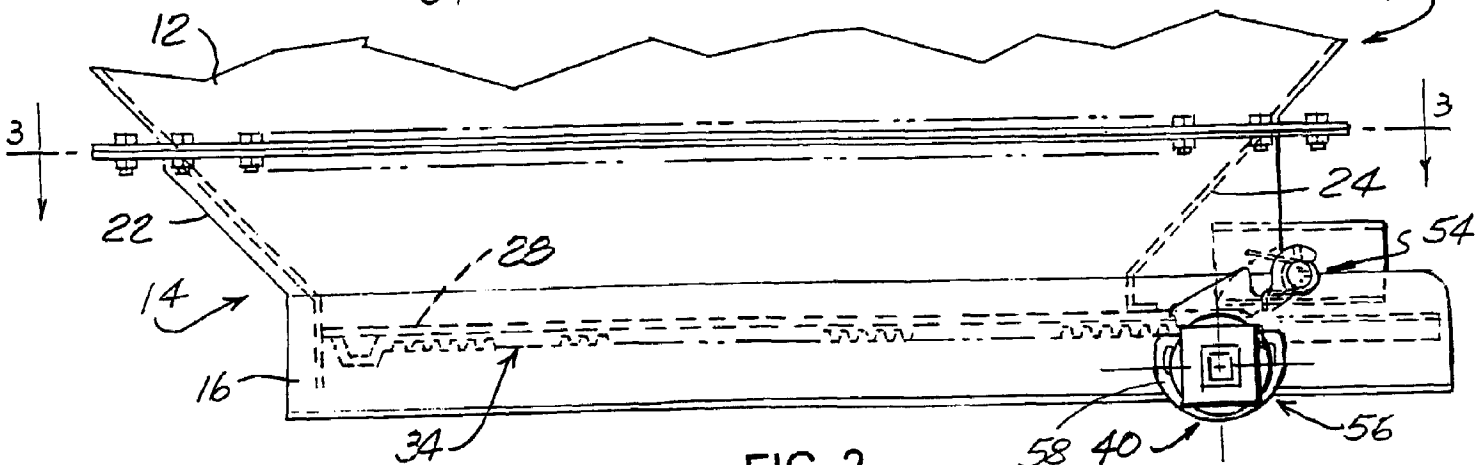
FIG. 2 is a side elevational view of the gate assembly shown in FIG. 1.
Figure 3:
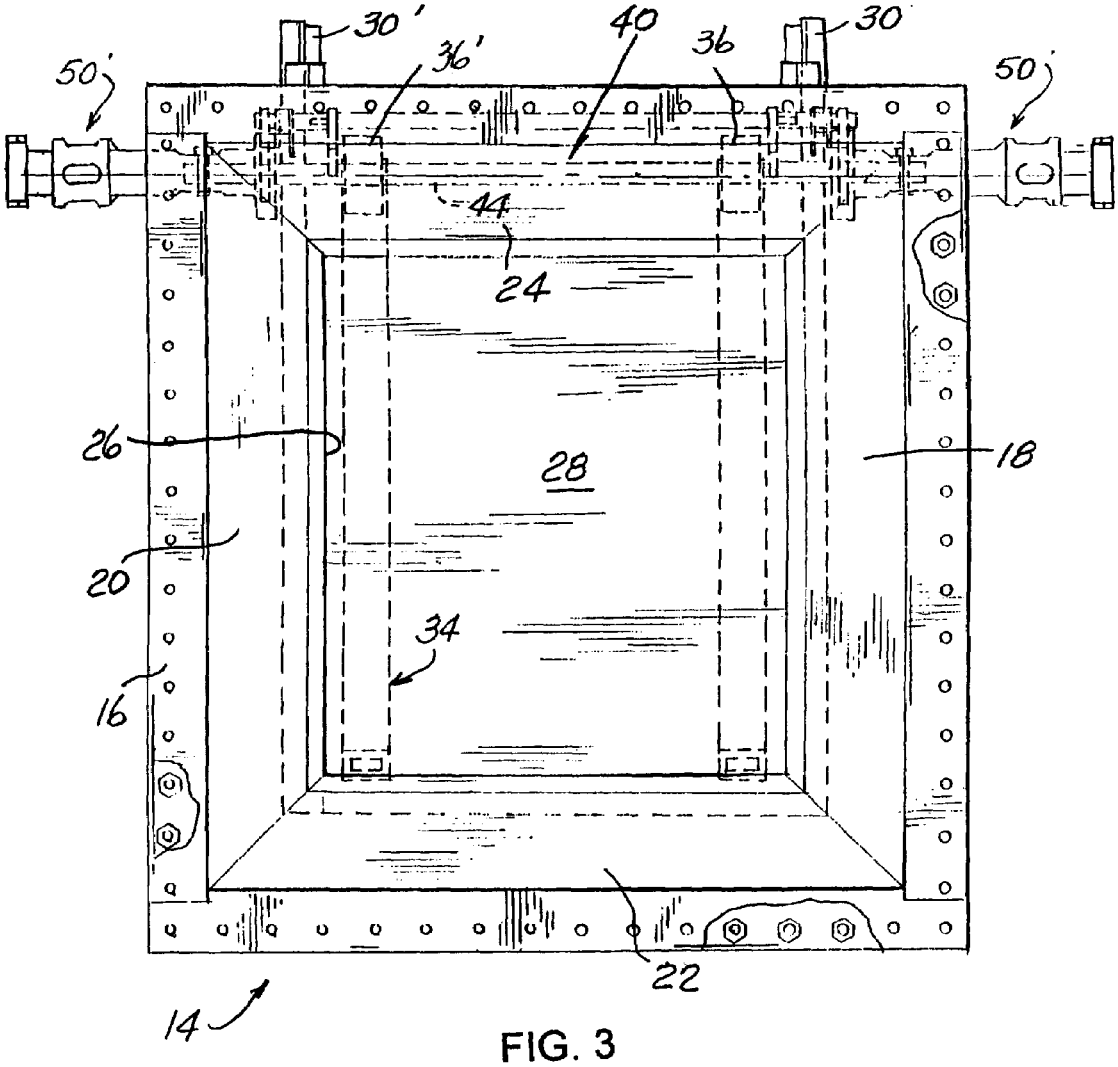
FIG. 3 is a top plan view taken along line 3-3 of FIG. 2.

As shown in FIGS. 1 through 3, gate assembly 14 further includes an operating shaft assembly 40 mounted for rotation about a fixed axis 42. The operating shaft assembly 40 is preferably mounted in a conventional manner for rotation by the frame extensions 30, 30'. The operating shaft assembly 40 is operably coupled to the gate 28 such that gate 28 linearly moves between open and closed positions in response to rotation of the operating shaft assembly 40 about axis 42.

In the embodiment illustrated in FIGS. 1 through 3, operating shaft assembly 40 extends transversely across the longitudinal axis of the railcar 10 and beneath the gate 28. It should be appreciated, however, the operating shaft assembly 40 can be otherwise arranged relative to the gate assembly 14 without departing or detracting from the spirit and scope of this invention.

According to this invention, and as shown in FIG. 1, the operating shaft assembly 40 includes an elongated operating shaft 44 having opposed ends 46 and 46'. In one form, the distance between the ends 46, 46' of the operating shaft 44 is greater than the predetermined distance laterally separating the frame extensions 30 and 30'. As shown, each end 46 and 46' of the operating shaft 44 has an operating handle or capstan 50 and 50', respectively, operably coupled thereto. The capstans 50, 50' arranged at the ends 46, 46' of the operating shaft 40 serve to rotatably mount the operating shaft assembly 40 to the frame extensions 28, 30 in a conventional manner.

Figure 4:
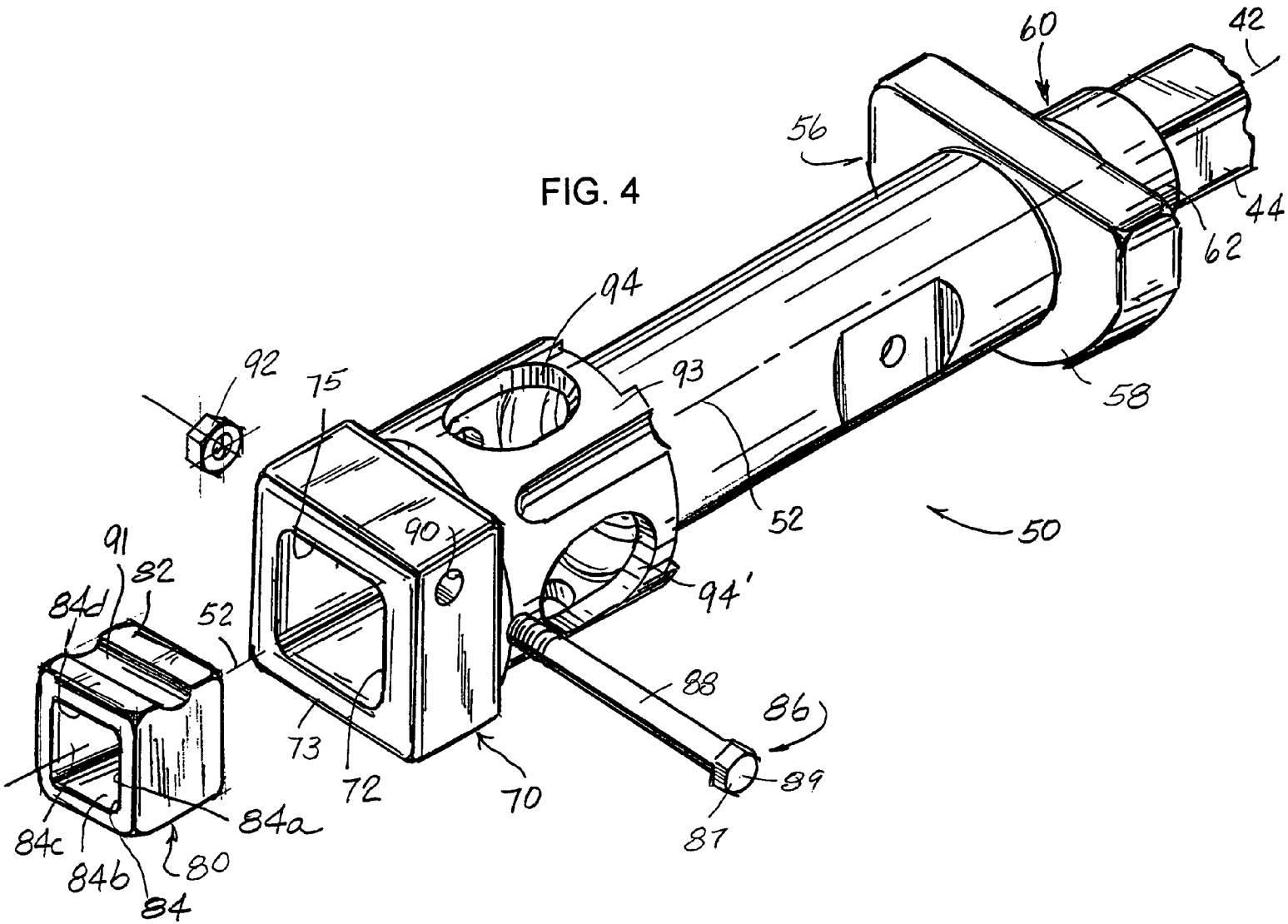
FIG. 4 is a perspective view of a railcar operating shaft assembly capstan embodying features of the present invention and illustrating some components of the capstan in disassembled relation relative to each other.

The capstans 50, 50' arranged at the ends of the operating shaft 44 are substantially mirror images of each other. Accordingly, only capstan 50 will be discussed in detail while providing an understanding of both capstans 50 and 50'. Turning to FIG. 4, each capstan preferably has a one-piece axially elongated configuration defining an elongated or longitudinal axis 52 which aligns with the axis 42 about which the capstan turns and has first and second axially aligned end portions 60 and 70, respectively. A hub bearing portion 62 is arranged adjacent to the first end portion 60 of each capstan. The hub bearing portion 62 serves to journal the capstan on one of the frame extensions 30, 30' (FIG. 1) of the gate assembly frame 16 for rotation about the fixed axis 42.

Besides being mounted on the gate assembly frame 16 for rotation, each capstan is releasably coupled in non-rotatable relation relative to one end of the operating shaft 44. In the embodiment shown in FIGS. 1, 4 and 5, the operating shaft 44 has a non-circular and solid cross-sectional configuration extending between ends 46, 46'. The non-circular cross-sectional configuration of shaft 44 is shown, by way of example, as being square. Given an understanding of this invention, it will be appreciated that the non-circular cross-sectional configuration of shaft 44 could likewise be oval, rectangular, triangular, or spline (along the long axis of shaft 44) without detracting or departing from the spirit and scope of the invention.

Turning to the embodiment illustrated in FIG. 5, each capstan defines a cavity or recess 64 which is axially aligned with the longitudinal axis 52. Recess 64 opens to the first end portion 60 of the capstan so as to allow for reception and accommodation of one end 46, 46' of the operating shaft 44. Preferably, recess 64 has a closed marginal edge configuration 66 substantially similar to that of the operating shaft 44. In one form, the closed marginal edge 66 of cavity 64 is configured to allow one end of shaft 44 to be longitudinally received therewithin while preventing rotation or rotary movement between the shaft 44 and capstan when the capstan is turned or rotated about axis 42.

After one end of the operating shaft 44 is arranged in operable combination with the capstan, and as shown in the preferred form illustrated in FIG. 5, a suitable fastener 68 releasably maintains the operating shaft 44 and capstan in operable combination. Although fastener 68 is shown as a conventional elongated and threaded bolt passing through the capstan and shaft 44 and which is secured by a conventional nut, it should be appreciated other fasteners, i.e. an elongated headed pin held in place by a suitable clip, shear pin, set screw or other types of conventional fasteners would equally suffice without detracting or departing from the spirit and scope of the invention.

Figure 7:
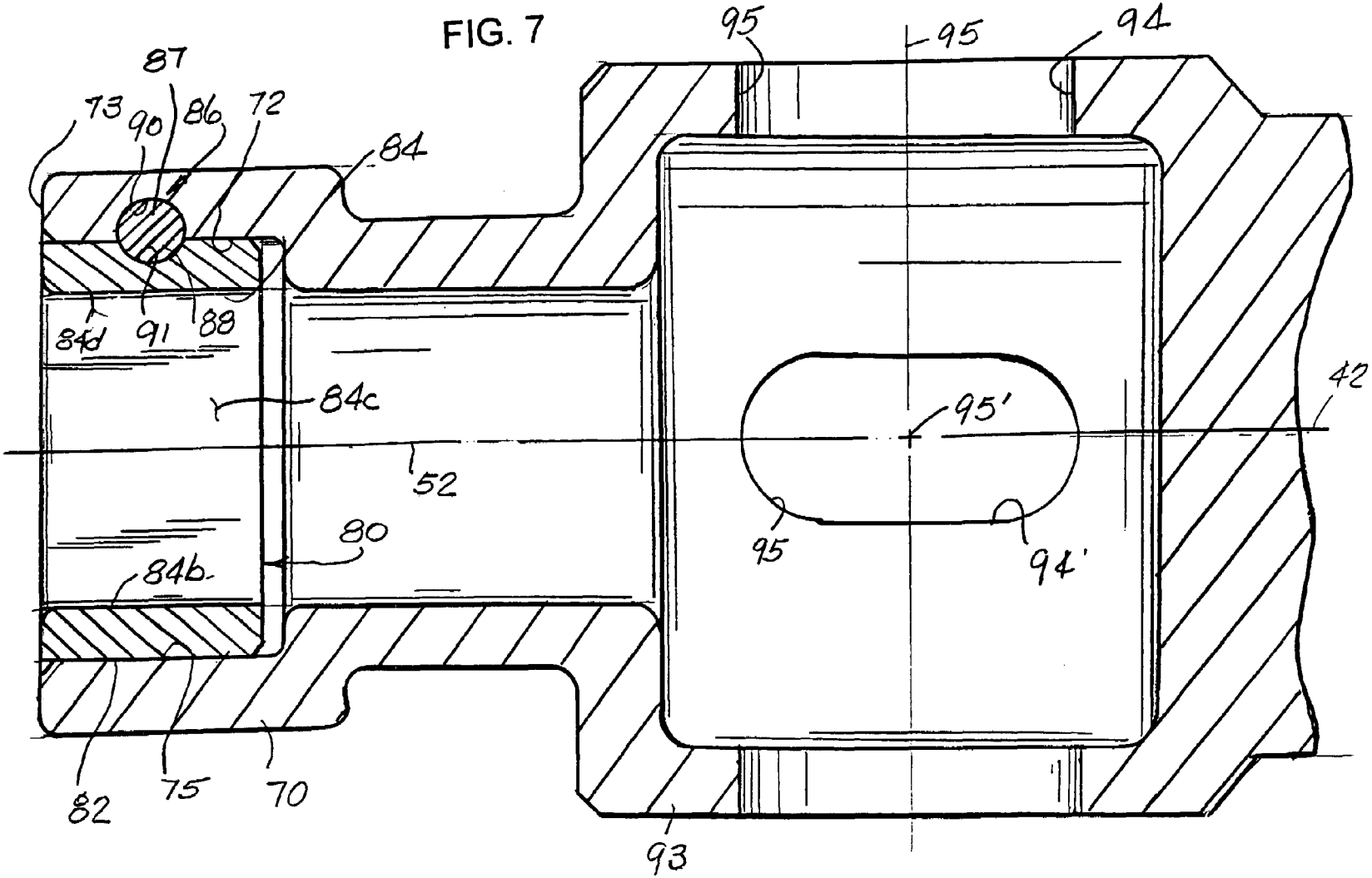
FIG. 7 is an enlarged sectional view taken along line 7-7 of FIG. 6.

As shown in FIGS. 4 and 6, the second end portion 70 of each capstan defines a socket or recess 72 axially extending from and opening to a free or terminal end 73 (FIG. 7) of the capstan. As shown in FIG. 7, the socket or recess 76 at the second end portion 72 of each capstan axially extends inwardly from the free or terminal end 73 and is coaxially aligned with the longitudinal axis 52 of the capstan. Preferably, the socket or recess 72, opening to the free terminal end 73 of the capstan, has a closed marginal edge 75. In the embodiment shown, by way of example, the marginal edge 75 of the socket or recess 76 is shown as being square. Given an understanding of this invention, it will be appreciated that the configuration of the marginal edge 75 of socket or recess 72 could likewise be oval, rectangular, triangular, or even round without detracting or departing from the spirit and scope of the invention.

According to the present invention, and as shown in FIGS. 4, 6 and 7, a replaceable insert 80 is configured for at least partial and non-rotatable accommodation within the socket or recess 72 defined at the second end portion 70 of each capstan. As shown in FIGS. 4 and 6, insert 80 has an exterior surface 82 which is configured substantially similar to the marginal edge configuration 75 of the cavity or recess 72 defined by and opening to the terminal end 73 of each capstan. As will be appreciated from an understanding of this form of the invention, the outer surface 82 of insert 80 is configured to allow at least a lengthwise portion of the insert 80 to be axially received within cavity 72 of the capstan while preventing rotation or rotary movement between the capstan and insert 80 when the capstan is turned or rotated about axis 42.

Because the marginal edge configuration 75 of the cavity or recess 72 defined by the capstan is illustrated, by way of example, as being generally square, the outer surface configuration 82 of that portion of the replaceable insert 80 to be axially received within the recess 72 is likewise shown by way of example as being generally square. Given an understanding of this invention, it should be appreciated that the outer surface configuration 82 of at least that portion of the insert 80 to be accommodated within the recess or cavity 72 at the second end 70 of the capstan will generally correspond to the closed marginal edge configuration of the recess 72 at the second end 70 of the capstan and vice versa, as long as rotational movements between insert 80 and the respective capstan accommodating same is prevented.

As shown in FIGS. 4 and 6, the replaceable insert 80 is provided with a plurality of surfaces 84*a* and 84*c* along with 84*b* and 84*d* flanking the elongated axis 52 of the capstan. At least two of the surfaces 84*a*, 84*b*, 84*c* and 84*d* are releasably engaged by a mechanized driver 100 (FIG. 1) used to forcibly impart rotation to the capstan and, thus, to the operating shaft assembly 44 to open and close the gate 28 (FIG. 1).

In the embodiment illustrated by way of example, insert 80 is configured with a throughbore 84 which, after insert 80 is received within the socket or recess 72, is axially aligned with the elongated axis 52 of the capstan. Suffice it to say, after being accommodated within the recess or cavity 72 defined by the capstan, the throughbore 84 in the insert 80 opens to the free or terminal end 73 of the capstan. The cavity or throughbore 84 defined by insert 80 has a closed and non-circular marginal edge configuration defined by surfaces 84*a*, 84*b*, 84*c* and 84*d* extending axially inward from the free or terminal end 73 of the capstan. In the illustrated embodiment, the marginal edge configuration of the bore or recess 84 defined by the insert 80 is sized and shaped to releasably and axially accommodate a drive spindle 102 (FIG. 1) of the mechanized driver 100. Preferably, the closed and non-circular marginal edge configuration of bore 84 is generally square but other non-circular configurations would equally suffice without detracting or departing from the spirit and scope of the invention.

In one form, the replaceable insert 80 is preferably fabricated from a material different from the material from which the capstan is fabricated. For example, the capstan is typically cast from cast iron or the like. With the present invention, the insert 80 can be formed from a material slightly more expensive than cast iron but which offers better wear characteristics.

Each capstan also preferably includes an apparatus 86 for positively locking or securing insert 80 within the socket 72 defined at the second end portion 70 of the capstan. In the form shown in FIGS. 4, 6 and 7, locking apparatus 86 includes an elongated threaded fastener 87 with a shank portion 88 and a head portion 89 (FIG. 4). The shank portion 88 of the fastener 87 passes through a bore 90 provided toward the second end portion 70 of the capstan. As shown in FIG. 7, a lengthwise portion of the bore 90 extending across the cavity 72 at the second end portion 70 of the capstan opens to the cavity 72. Moreover, and as shown, the outer surface configuration of insert 80 defines an open sided channel or groove 91 extending across one surface thereof.

When the replaceable insert 80 is properly arranged within the socket 72, marginal edges of the bore 90 and the open-sided channel or groove 91 on insert 80 align and cooperate relative to each other and are sized as to accommodate endwise passage of the fastener shank portion 88 therethrough. As shown in FIG. 7, after the fastener 87 is passes endwise through the bore 90, a section of the shank portion 88 of fastener 87 is arranged in positive engagement with both the marginal edge of the bore 90 as well as the marginal edge of the open-sided channel 91 whereby inhibiting inadvertent axial separation of the insert 80 from within the cavity or recess 72 at the second end portion 70 of the capstan. As shown in FIGS, 4 and 6, a conventional threaded nut or suitable retainer 92 inhibits the fastener 87 from endwise shifting movements. As will be appreciated, the locking apparatus 86 can also be configured as a set screw arranged toward the second end portion 70 of the capstan and which is adapted to engage the exterior surface of the insert whereby clamping insert 80 within the socket 72. Alternatively, rivets, or welding, or shear pins, or wedges could be used to releasably secure the insert 80 in place relative to the capstan. Suffice it to say, locking apparatus 80 can take a myriad of different forms from that shown without detracting or departing from the spirit and scope of the invention.

To allow for manual operation of the operating shaft assembly 40, the second end portion 70 of each capstan is preferably configured with a hollow head portion 93. In the embodiment illustrated for exemplary purposes, the hollow head portion 93 of each capstan defines two pairs 94 and 94' of openings passing therethrough. Each opening in each pair of openings 94, 94' preferably has a closed marginal edge 95. Moreover, in the preferred embodiment, each pair of openings 94, 94' is disposed in generally normal relation relative to the other pair of openings 94, 94'. Furthermore, each pair of openings 94, 94' is disposed along an axis 95, 95' extending generally normal to the elongated axis 52 of the capstan. Suffice it to say, each opening of each pair of openings 94, 94' is sized to releasably accommodate a conventional and well known elongated opening bar (not shown) used to manually rotate the operating shaft assembly 40 to open/close the gate 28 (FIG. 1).

The gate assembly 14 illustrated for exemplary purposes preferably uses a conventional rack and pinion arrangement 34 (FIGS. 2 and 3) for operably coupling the operating shaft assembly 40 to the gate 28. As such, and as shown in FIGS. 1 and 3, the operating shaft assembly 40 can further include a pair of substantially identical pinion gears 36 and 36' mounted in laterally spaced relation on and for rotation with the operating shaft 44.

The gate assembly 14 illustrated for exemplary purposes furthermore includes a lock assembly, generally identified in FIG. 1 by reference numeral 54, and which is operable in timed relation relative to movement of the gate 28 toward an open position. A fuller description of lock assembly 54 is provided in coassigned U.S. Pat. No. 5,829,359; the applicable portions of which are incorporated herein by reference For railcar gate assemblies including a lock assembly 54 similar to that disclosed in U.S. Pat. No. 5,829,359, at least one of the capstans 50, 50', and preferably both capstans 50, 50', arranged in operable combination with the operating shaft assembly 40 include a lock actuator 56 for allowing lock assembly 54 to be operated in timed relation with movement of the gate 28 toward an open position. As shown, each capstan 50, 50' includes radial cam structure 58. The cam structure 58 radially projects outwardly from and is provided between the first and second end portions 60, 70 of the capstan. As described in U.S. Pat. No. 5,829,359, the cam structure 58 on one or both capstans 50, 50' operably serves as the actuator 56 for lock assembly 54.

Figure 8:
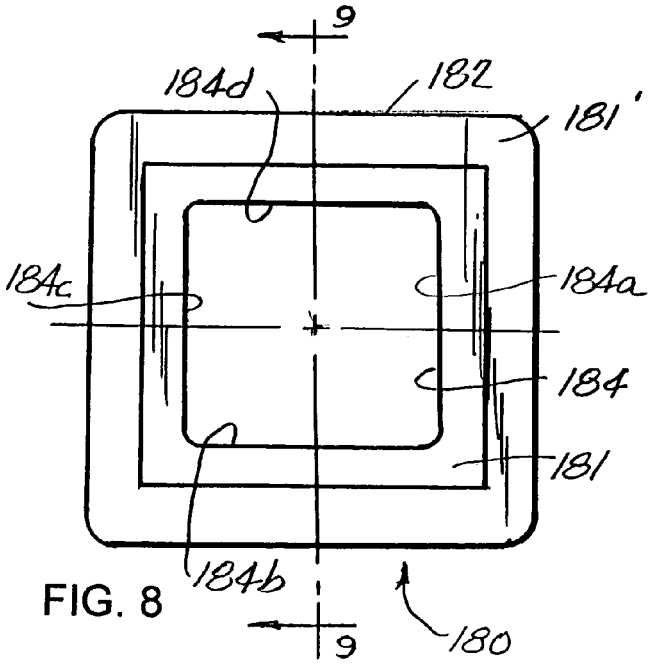
FIG. 8 is an enlarged side view of an alternative component for the operating shaft assembly capstan embodying features of the present invention.
Figure 9:
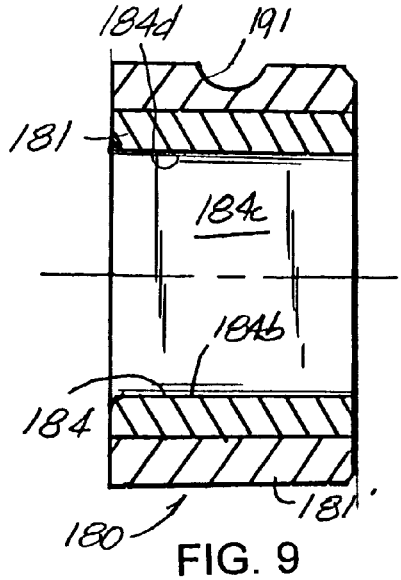
FIG. 9 is a sectional view taken along line 9-9 of FIG. 8.

FIGS. 8 and 9 illustrate an alternative form for the replaceable insert to be axially and non-rotatably accommodated toward the second end portion of each capstan. This alternative form of insert is designated generally by reference numeral 180. The elements of this alternative insert form that are functionally analogous to those elements discussed above regarding insert 80 are designated with reference numerals identical to those listed above with the exception this embodiment uses reference numerals in the 100 series.

In the form illustrated in FIGS. 8 and 9, the insert 180 comprises a first or inner member of material 181 and a second or outer member 181' arranged in layered and non-rotatable relation relative to each other. As shown, member 181 of insert 180 defines a throughbore 184. After the replaceable insert 180 is arranged in operable combination with a capstan, the throughbore 184 opens to the free or terminal end of the capstan. The cavity or throughbore 184 defined by replaceable insert 180 is axially aligned with the elongated axis of the capstan and has a closed and non-circular marginal edge configuration defined by surfaces 184*a*, 184*b*, 184*c* and 184*d* extending axially inward from the free or terminal end of the capstan; with surfaces 184*a* and 184*c* along with surfaces 184*b* and 184*d* being arranged in flanking sides of the axis 42 about which the assembled capstan rotates. Suffice it to say, the marginal edge configuration of the bore or recess 184 defined by the insert 180 is sized and shaped to releasably and axially accommodate a drive spindle 102 (FIG. 1) of the mechanized driver 100.

The second member 181' of insert 180 is configured to non-rotatably fit about the first member 181 and has an outer surface configuration 182 substantially similar to the marginal edge configuration of the insert receiving recess 72 (FIGS. 4 and 6) defined by and opening to the terminal end of each capstan. Suffice it to say, the outer surface 182 of insert 180 is configured to allow at least a lengthwise portion of the insert 180 to be axially received within cavity of the capstan while preventing rotation or rotary movement between the capstan and insert 180 when the insert 180 is turned or rotated by the mechanized driver 100. As shown in FIG. 9, the outer surface 182 of the outer layer of material 181' defines an open sided channel 191 extending thereacross. The groove or open-sided channel 191 is provided to allow insert 180 to cooperate with the locking apparatus 86 in the same manner as discussed above regarding insert 80.

In one form, the first and second members 181 and 181', respectively, of the replaceable insert 80 are preferably fabricated from different materials. For example, the outer member 181 can be formed from any of several suitable materials, including, but not limited to, cast iron, steel, etc. Whereas, the inner member 181 can be fabricated from a very hard, very tough material, i.e. titanium, and the like, so as to increase the wear life and overall durability of the insert 180.

Figure 10:
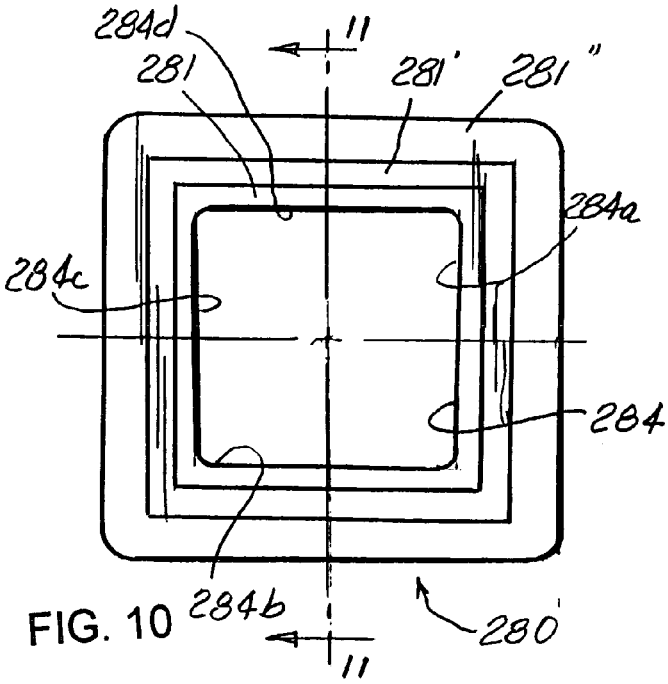
FIG. 10 is an enlarged side view of another alternative component for the operating shaft assembly capstan embodying features of the present invention.
Figure 11:
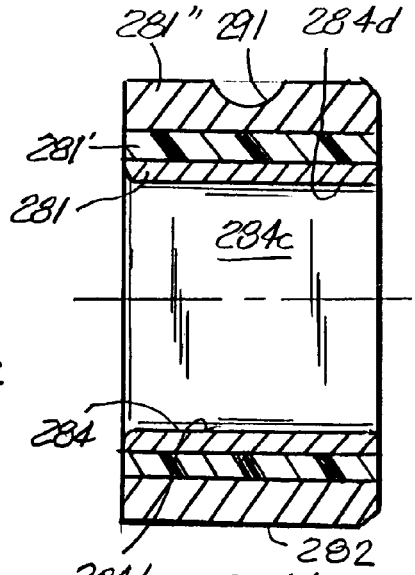
FIG. 11 is a sectional view taken along line 11-11 of FIG. 10.

FIGS. 10 and 11 illustrate another alternative form for the replaceable insert to be axially and non-rotatably accommodated toward the second end portion of each capstan. This alternative form of insert is designated generally by reference numeral 280. The elements of this alternative insert form that are functionally analogous to those elements discussed above regarding insert 80 are designated with reference numerals identical to those listed above with the exception this embodiment uses reference numerals in the 200 series.

In the form illustrated in FIGS. 10 and 11, the replaceable insert 280 comprises multiple layers of material 281, 281' and 281" arranged in substantially non-rotatable relation relative to each other. As shown, the innermost layer 281 of insert 180 defines a throughbore 284. After the replaceable insert 280 is arranged in operable combination with a capstan, the throughbore 284 opens to the free or terminal end of the capstan and is axially aligned with the elongated axis of the capstan. Bore 284 of insert 280 preferably has a closed marginal edge configuration defined by surfaces 284*a*, 284*b*, 284*c* and 284*d*; with surfaces 284*a* and 284*c* along with surfaces 284*b* and 284*d* being arranged in flanking relationship relative to the axis about which the assembled capstan turns. In the illustrated embodiment, the marginal edge configuration of the bore or recess 284 defined by the insert 280 is sized and shaped to releasably and axially accommodate a drive spindle 102 (FIG. 1) of the mechanized driver 100.

The outermost layer 281" of insert 280 is configured larger than and fits about the inner layer 281. The outer surface configuration 282 of the replaceable insert 280 is substantially similar to the marginal edge configuration of the insert receiving cavity defined by and opening to the terminal end of the capstan. Suffice it to say, the outer surface 282 of insert 280 is configured to allow at least a lengthwise portion of the insert 280 to be axially received within cavity of the capstan while preventing rotation or rotary movement between the capstan and insert 280 when the insert 280 is turned or rotated by the mechanized driver 100. As shown in FIG. 11, the outer surface 282 of the outermost layer of material 281" defines an open sided channel 291 extending thereacross. The open-sided channel 291 is provided so as to allow insert 280 to cooperate with the locking apparatus 86 in the same manner as discussed above regarding insert 80.

In the illustrated embodiment, the mid-layer of material 281' is fabricated from an elastomeric material such as natural rubber, synthetic rubber, nylon, plastic or other conventional material capable of absorbing and dissipating or attenuating impacts. As such, when a large turning torque is imparted to the inner layer 281 of the insert 280 by a rotating drive spindle 102 (FIG. 1) of the mechanized driver 100, the mid-layer 281' of the insert 280 will absorb and act to dissipate a portion of the impact imparted or transferred to the outer layer 281" of the replaceable insert 280 thereby prolonging the usefulness of the insert 280.

Having a railcar gate assembly operating shaft assembly wherein each capstan at opposite ends of the operating shaft 44 has a replaceable insert arranged in operable combination therewith offers numerous benefits over heretofore known operating shaft assembly designs. First, the ability to repair/replace only the worn portion of the capstan—rather than the entire capstan as was heretofore required—is economically feasible and cost effective. That is, and should the surfaces on the capstan engaged by the mechanical opener 100 become worn thus requiring repair/replacement of the capstan, with the present invention, only the insert which is actually worn needs to be replaced rather than the entire capstan.

Second, the operating shaft assembly design taught by this invention allows the worn portion of the operating shaft assembly to be replaced within minimal time constraints and without involving or requiring skilled labor. That is, replacing only those capstan surfaces worn by the mechanized driver 100 is readily achieved simply by replacing the worn surfaces with a replaceable insert non-rotatably accommodated at the terminal end of the capstan With the present invention, replacing the insert 80 is easily accomplished simply though undoing of the locking apparatus 86 used to hold the insert 80 in operable combination with the capstan. Since the locking apparatus 86 is of such a simple design, no special skills are required to affect timely repair/replacement of the worn portion of the capstan. Additionally, the worn parts on each capstan can be replaced without having to remove the car from active service.

Moreover, the insert 80 for the capstan assembly can be formed or fabricated from a relatively low cost material. That is, the insert 80 could be formed from a material the same as the remainder of the capstan or from some material slightly more expensive but with better wear characteristics, thus, improving the durability of the wear surfaces on the capstan. Alternatively, the layered design of the capstan permits a relatively hard faced material to define the wear surfaces of the capstan and a more economical material for the second layer of the insert. In still another alternative form, the replaceable insert is preferably configured with multiple layers and is designed to attenuate torque impacts imparted to a non-rotating capstan by a rotating drive spindle of a mechanized driver used to forcibly open the gate assembly from a closed position.

An operating shaft assembly for a railcar gate assembly which incorporates a capstan having replaceable wear surfaces at that end of the capstan engaged by the mechanized driver furthermore allows for repair/replacement of only the worn portion of the capstan without endangering the drive relationship between the operating shaft assembly 40 and other mechanisms on the railcar gate assembly operated by the shaft assembly 40. That is, with the present invention, only the worn portion at the free end of the capstan is required to be replaced without requiring disassembly of the entire operating shaft, including the pinion gears 36, 36', from operable drive association with the gate assembly 14. Accordingly, concerns over the pinion gears 36, 36' disengaging from the operating shaft 44 and thereafter having to reset and maintain an appropriate relationship between the operating shaft 44, pinion gears 36, 36', and gate position are eliminated.

From the foregoing, it will be observed that numerous modifications and variations can be made and effected without departing or detracting from the true spirit and novel concept of the present invention. Moreover, it will be appreciated, the present disclosure is intended to set forth exemplifications of the invention which are not intended to limit the invention to the specific embodiments illustrated. Rather, this disclosure is intended to cover by the appended claims all such modifications and variations as fall within the spirit and scope of the claims.

What is claimed is:

1. An operating shaft assembly for a railcar, said operating shaft assembly being mountable for rotation on a railcar gate assembly frame, said operating shaft assembly comprising: an operating shaft having first and second ends; a capstan provided at each end of said operating shaft and mountable for rotation on said gate assembly frame, with each capstan defining an elongated axis about which said capstan rotates and having first and second axially aligned end portions, with one end portion of each capstan being releasably connectable to one end of said operating shaft, and with the second end portion of each capstan defining a socket opening to a terminal end of the second end portion of said capstan, and wherein said socket is axially aligned with said longitudinal axis of said capstan; an insert non-rotatably accommodated at the second end portion of each capstan, with said insert defining a bore which axially aligns with the longitudinal axis of the capstan after said insert non-rotatably accommodated at the second end portion of each capstan, and wherein said insert defines a closed and non-circular marginal edge in surrounding relation relative to said bore and extending axially inward from the terminal end at the second end portion of said capstan; and a locking apparatus for positively securing said insert relative to said capstan so as to inhibit inadvertent separation of said insert from said capstan.

2. The operating shaft assembly for a railcar according to claim 1, wherein a fastener releasably couples said capstan and said operating shaft in operable combination relative to each other.

3. The operating shaft assembly for a railcar according to claim 1, wherein said capstan is provided with cam structure.

4. The operating shaft assembly form a railcar according to claim 1, wherein said insert includes first and second members arranged in layered relationship relative to each other.

5. The operating shaft assembly for a railcar according to claim 4, wherein said first and second members are fabricated from different materials.

6. The operating shaft assembly for a railcar according to claim 1, wherein said insert includes multiple layers of material including an elastomeric material for attenuating impacts imparted to said insert.

7. The operating shaft assembly for a railcar according to claim 1, wherein said capstan further includes a head portion arranged toward the second end portion thereof, with said head portion defining two pairs of openings passing therethrough, with each pair of openings having a closed marginal edge and being disposed in generally normal relation relative to the other, and with each pair of openings being disposed along an axis extending generally normal to the elongated axis of said capstan.

8. The operating shaft assembly for a railcar according to claim 1, further including a pair of substantially identical pinion gears mounted on said operating shaft.

9. An operating shaft assembly for a railcar, wherein said operating shaft assembly is mountable for rotation about a fixed on a railcar gate assembly frame, said operating shaft assembly comprising: an axially elongated operating shaft having first and second ends; an axially elongated one-piece capstan operably connected at each end of said operating shaft for rotatably mounting said operating shaft assembly on said gate assembly frame, with each capstan defining an elongated axis about which said capstan rotates and having first and second axially aligned end portions, with one end portion of each capstan defining a bore for non-rotatably accommodating one end of said elongated operating shaft, and with the second end portion of each capstan defining a cavity opening to a terminal end of the second end portion of said capstan, and wherein said cavity is axially aligned with said elongated axis of said capstan; a replaceable insert non-rotatably accommodated at the second end portion of each capstan, with said insert defining a bore which after said insert non-rotatably accommodated at the second end portion of each capstan is axially aligned with the elongated axis of the capstan and with said insert having a closed and non-circular marginal edge in surrounding relation relative to said bore and extending axially inward from the terminal end at the second end portion of said capstan; and an apparatus for positively locking said insert relative to said capstan so as to inhibit inadvertent separation of said insert from said capstan.

10. The operating shaft assembly for a railcar according to claim 9, wherein said insert and said capstan are fabricated from different materials.

11. The operating shaft assembly for a railcar according to claim 9, wherein said insert includes first and second members arranged in layered relationship relative to each other.

12. The operating shaft assembly for a railcar according to claim 11, wherein said first and second members are fabricated from different materials.

13. The operating shaft assembly for a railcar according to claim 9, wherein said insert includes multiple layers of material including an elastomeric material for attenuating impacts imparted to said insert.

14. The operating shaft assembly for a railcar according to claim 9, wherein said capstan further includes a head portion arranged toward the second end portion thereof, with said head portion defining two pairs of openings passing therethrough, with each pair of openings having a closed marginal edge and being disposed in generally normal relation relative to the other, and with each pair of openings being disposed along an axis extending generally normal to the elongated axis of said capstan.

15. The operating shaft assembly for a railcar according to claim 9, further including a pair of substantially identical pinion gears mounted on said operating shaft.

16. A capstan for an operating shaft assembly of a railcar gate assembly, said capstan defining an elongated axis about which said capstan rotates along with first and second axially aligned and spaced end portions, with one end portion of said capstan defining a bore with a closed non-circular marginal edge, and with the second end portion of said capstan defining a cavity opening to a terminal end of the second end portion of said capstan, and wherein said cavity is axially aligned with said elongated axis of said capstan; with said capstan further including an insert arranged in axially aligned relation relative to the elongated axis of said capstan, with at least a portion of said insert being axially and non-rotatably accommodated at the second end portion of said capstan such that rotational movement imparted to said insert is transferred to said capstan, and wherein said insert has at least two surfaces arranged, at least in part, in flanking relationship with and extending generally parallel to the elongated axis of said capstan; and wherein said capstan further includes an apparatus for positively locking said insert said capstan so as to inhibit inadvertent separation of said insert from said capstan.

17. The capstan according to claim 16, wherein said insert defines a bore adapted to be axially aligned with the elongated axis of said capstan and having a closed marginal edge configuration extending axially inward from the terminal end at the second end portion of said capstan.

18. The capstan according to claim 16, wherein at least a portion of said insert and said capstan are fabricated from different materials.

19. The capstan according to claim 16, wherein said insert includes first and second members arranged in layered relationship relative to each other.

20. The capstan according to claim 19, wherein said first and second members of said insert are fabricated from different materials.

21. The capstan according to claim 16, wherein said insert includes multiple layers of material including an elastomeric material for attenuating impacts imparted to said insert.

22. The capstan according to claim 16, further including a head portion arranged toward the second end portion of said capstan, with said head portion defining two pairs of openings passing therethrough, with each pair of openings having a closed marginal edge and being disposed in generally normal relation relative to the other, and with each pair of openings being disposed along an axis extending generally normal to the elongated axis of said capstan.

* * * * *